US005299772A

United States Patent [19]

Weber

[11] Patent Number: 5,299,772

[45] Date of Patent: Apr. 5, 1994

[54] MULTIFUNCTIONAL TOOLS FOR ARTISTS

[76] Inventor: Michael S. Weber, 510 W. Belmont, Chicago, Ill. 60657

[21] Appl. No.: 979,882

[22] Filed: Nov. 23, 1992

[51] Int. Cl.[5] ..... A47B 19/00

[52] U.S. Cl. ..... 248/441.1; 248/460

[58] Field of Search ..... 248/441.1, 444.1, 451, 248/452, 454, 455, 456, 460, 463, 465

[56] References Cited

U.S. PATENT DOCUMENTS

| | | | |
|---|---|---|---|
| 289,700 | 12/1883 | Parker | 248/441.1 |
| 2,522,270 | 9/1950 | Hoffmann | 248/465 |
| 2,814,142 | 11/1957 | Warwick | 248/441.1 |
| 3,815,856 | 6/1974 | Cortimilia | 248/463 X |
| 3,972,133 | 8/1976 | Parshall | 248/441.1 X |
| 4,057,215 | 11/1977 | Stettler | 248/460 |
| 4,453,470 | 6/1984 | Capella | 248/464 X |
| 4,576,351 | 3/1986 | Brink | 248/214 X |
| 5,141,198 | 8/1992 | Hout | 248/460 X |

*Primary Examiner*—J. Franklin Foss

*Attorney, Agent, or Firm*—Paul H. Gallagher

[57] ABSTRACT

A swing clamp detachably clamped onto the frame of a vertical artist's canvas structure. A hand bridge releasably mounted on the clamp, and movable relative to the art surface, for resting the hand thereon, and also for detachably holding a pallet. The hand bridge can also be used, independently, in placing it above a horizontal art surface, for resting the hand. A pallet can be detachably mounted on the hand bridge and slid therealong and also rotated thereon. The pallet can also be used independently for holding by the hand, by means of a handle entirely under the pallet board.

19 Claims, 2 Drawing Sheets

MULTIFUNCTIONAL TOOLS FOR ARTISTS

BACKGROUND OF THE INVENTION

The invention resides in the broad field of tools and instruments for artists, both in using paints, i.e., paste or liquid, or in drawing, i.e., using pencil or charcoal, not pasty or liquid. Various difficulties and obstacles have been encountered by artists in both of these subfields and the present invention is directed to overcoming those difficulties and obstacles. The invention is embodied in several independent tools or items, that some of which can be utilized independently and alone, and they may also be used in certain circumstances in an assembly. For convenience, the individual tools or items may be referred to collectively, as apparatus, or device.

Difficulties encountered heretofore, include the following:

A. Hand contact with the art surface.

B. Hand contact with the pallet.

C. Steadiness, or lack of steadiness, in the painting/-drawing hand.

D. Positioning of the pallet relative to the art surface, vertically arranged, when mounted in the apparatus.

A. When painting or drawing, upon a horizontal surface such as a drawing board or table top, the artist's hand tends to smudge the material that was already applied to the art surface, and this was true whether the mediums were wet such as paints, inks, or dry, such as graphite, pastels, etc. Also oils and sweat from the hands may soil the art surface. In this step, both the art surface, and the artist's hand, were affected. Among the steps taken heretofore to overcome such a problem included placing a piece of paper on the drawing to act as a barrier between the working hand and the art surface, but the difficulties involved in this step are quite obvious, including as a principal one, smearing of the art surface.

An object of the invention is to provide means for overcoming this difficulty, which includes a hand bridge which may be utilized for spacing the hand from the art surface in the act of drawing or painting upon a horizontal art surface.

B. In the use of pallets known heretofore, very generally a hole was provided in the pallet for the user to extend his thumb through it, and the thumb engaged the upper surface of the pallet in holding it. This was objectionable for several reasons, a main one of which is that many paints and related mediums are toxic, and the user often encountered adverse conditions resulting from engagement with such mediums. As a less serious difficulty, the pallet was difficult to hold in the desired position, because it could be gripped in only a single manner.

Another important object of the invention is to provide a pallet with a special construction enabling it to be held by the hand by means of a handle on the back side of the pallet, so that the pallet may be held as desired and without the hand engaging any of the paint or other mediums on the pallet. Additionally this same handle enables the pallet to be mounted or incorporated in the complete apparatus or assembly, for a purpose referred to in "D" above. Still further, the pallet is provided with an arrangement, including a hole therethrough, for extending brushes and pencils therethrough for grasping by the hand of the user, on the underside of the pallet, while enabling these brushes and pencils to extend above the top surface of the pallet to enable the user to quickly grasp them and manipulate them.

C. It is well known that steadiness, or lack of steadiness, in the hand is an extremely great factor in art work. This steadiness factor is involved both in the immediate act of applying a medium to the art surface, and in the overall condition of the hand, such as fatigue or weariness. Q The present invention overcomes this problem to a great extent, by means of a novel hand bridge. This hand bridge may be used alone, independently of the other tools, or it may be used in the assembly or combination of all of the tools. As a separate item, it can be placed over the top of the art surface and the hand in resting on it, is held spaced from the art surface, eliminating smearing. It may be placed in any of several different positions for providing variable and different heights above the art surface, for using brushes, or pencils, respectively, which require holding at different positions, relative to the art surface.

Additionally, this same hand bridge can be incorporated with another component of the apparatus, the swing clamp, and when so mounted, it can be moved relative to the vertical art surface for producing the desired spacing of the hand from the art surface. In the use of the hand bridge in this manner, it may be compared with the manner in which Norman Rockwell painted, i.e., he used a rod having one end bearing on the art surface and the other end held in his hand. However, in that case, the rod was unattached and loose, and was correspondingly rather difficult to hold and manipulate, and there may not be a convenient and clear spot on which to rest the rod. In contrast to that, the hand bridge in the present case is mounted in the apparatus, free of the user's support, and is very convenient and can be easily positioned relative to the art surface both as to location within the bounds thereof and as to spacing therefrom. The arrangement accommodates great versatility of the artist.

D. Heretofore it has been difficult to position the pallet relative to the art surface, in the act of painting. When the artist held the pallet in one hand, he was handicapped to an extent, in that since one hand was occupied in holding the panel, the artist was not free to use both hands for various manipulations. In the present case, in the complete assembly or apparatus, the hand bridge is mounted in a clamp, and the pallet is mounted on the hand bridge, leaving both hands of the artist free. The hand bridge is mounted for movement relative to the art surface, and accordingly the pallet can be positioned relative to the art surface both as to spacing therefrom, and positioning it at various locations at the art surface. Heretofore when a pallet was not held in the hand, it may have been set on a separate piece of furniture, or mounted at the bottom of the art surface and in the case of a large painting, the artist necessarily had to move about, such as bending over and straightening up, or stepping, to reach the pallet and the art surface in the act of painting.

Another feature in this phase of the invention, is that the pallet when mounted on the hand bridge, is so mounted that it is rotatable about a vertical axis, so that the artist may place different mediums at different locations on the periphery of the pallet, and then move the pallet, rotationally, to place the desired medium, such as a particular color, adjacent the location on the art surface, providing a great convenience in minimum movement of the hand between the medium and the art surface.

BRIEF DESCRIPTION OF THE VARIOUS FIGURES OF THE DRAWINGS

DETAILED DESCRIPTION

Referring in detail to the drawings, and referring first to FIGS. 1–4, the apparatus of the present invention is indicated in its entirety at 16, and it is shown mounted on a canvas 18. For purposes of convenience reference will be first made to the canvas, and thereafter the apparatus itself, both as to its character and its mounting on the canvas.

The canvas 18 is shown mounted on an easel 20. The canvas and the easel are of known character, the canvas resting on members 22 and secured thereby to the easel. The canvas as shown is upright, and nearly vertical, and for convenience herein, it will be referred to as positioned vertically, and other items positioned correspondingly. It will be understood that in any other position, all references are to be interpreted accordingly.

Figure 5:
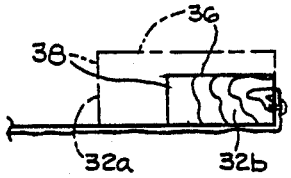
FIG. 5 is a sectional view taken at line 5—5 of FIG. 2.
Figure 3:
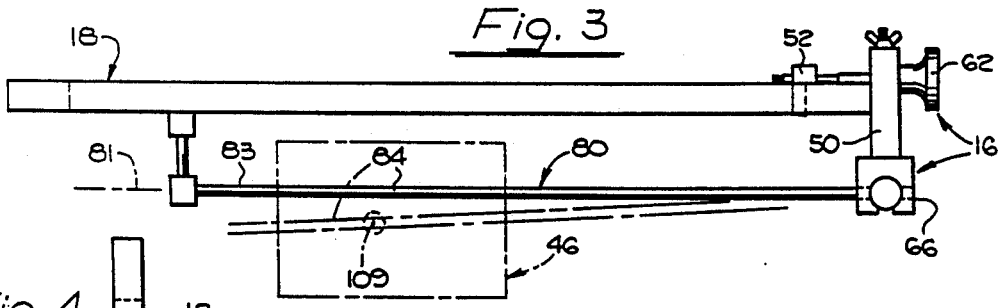
FIG. 3 is a view from the top of FIG. 1, excluding the easel.
Figure 4:
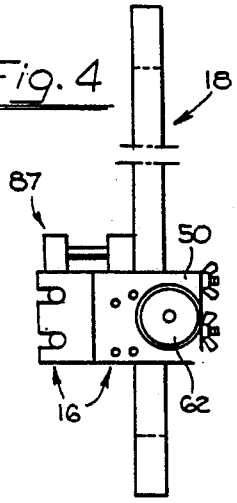
FIG. 4 is a view from the right hand end of FIG. 1.

The canvas 18 as noted above is of known construction, and it includes a canvas fabric 24 secured to a frame 26 as indicated at 28. The fabric and the frame together may also be referred to as a canvas structure, for convenience. The fabric presents what is referred to as an art surface 30, at the front, and the frame 26 is made up of a plurality of stretcher strips 32 secured together, such as by mitered joints 34. Canvases are now produced generally in two kinds, having stretcher strips of different dimensions. In one case the stretcher strips are $2\frac{1}{4}'' \times 1\frac{1}{4}''$ in cross-section, and the other $1\ 5/16'' \times 7/8''$. The former will be referred to herein as the large size and the latter as the small size. Both are shown in FIG. 5 indicated at 32*a*, 32*b*, respectively. Each stretcher strip has a width dimension 36, a thickness dimension 38 and (FIG. 2) a length dimension 40. The apparatus of the present invention incorporates a special and novel feature for accommodating each the large and small size stretcher strips, as described fully below.

In the following description of the apparatus 16 itself, the order of presentation is not necessarily in the same sequence as in the description of the use thereof, this variation being utilized for facilitating the nature of the structure, and its use.

The apparatus 16 includes three main components, namely a clamp 42 which will be referred to herein as a swing clamp, a hand bridge 80 and a pallet 46 which may also be referred to as a pallet hat.

The clamp 42 (FIG. 2) has a longitudinal axis 48 which will extend front to rear perpendicular to the canvas, in its mounted position on the canvas.

The clamp 42 includes an outer clamping jaw 50 and an inner clamping jaw 52. These jaws may be made of suitable material, such as plastic, aluminum, etc. The outer jaw may be a simple rectangular block, and has an inner clamping surface 53. The inner clamping jaw (FIGS. 11 and 12) is generally L-shape having a forward leg 54 and a rear leg 56. These legs have respective inside surfaces 54*a*, 56*a* preferably at a 90° angle relative to each other, and these surfaces together are preferably at an angle relative to the respective outer surfaces in the neighborhood of 7°.

Figure 6:
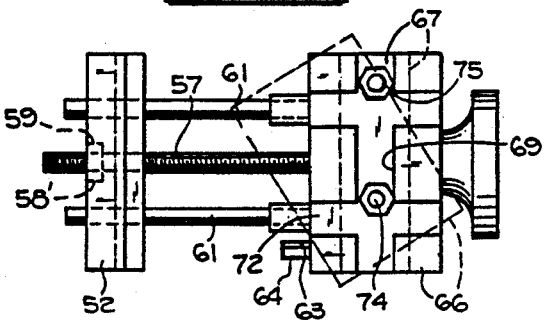
FIG. 6 is a face view taken as indicated by the arrow 6 of FIG. 2.
Figure 11:
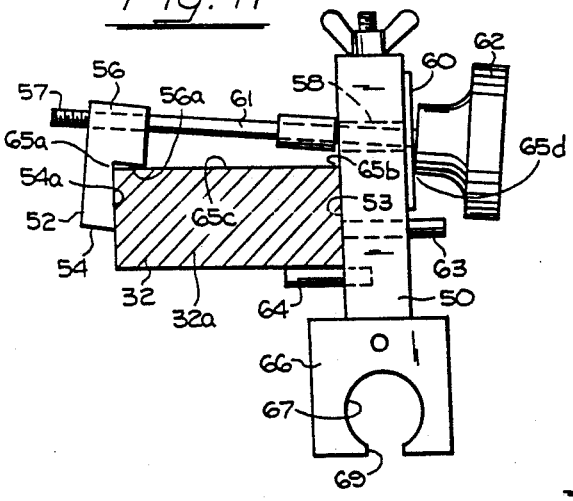
FIG. 11 is a top view, of the swing clamp, oriented according to the arrow 11 of FIG. 1.
Figure 12:
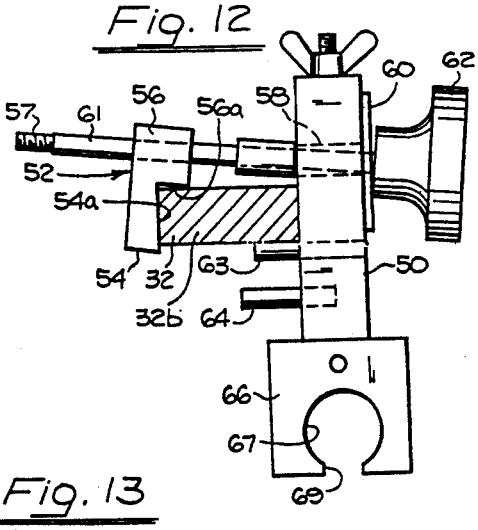
FIG. 12 is a view similar to FIG. 11 but showing the apparatus mounted on a smaller stretcher strip.

A threaded rod 57 (FIGS. 6, 11, 12) is inserted through a hole 58 in the clamp jaw 50 and a threaded hole 58' (FIG. 6) in clamp jaw 52, where a nut 59 is threaded thereon, and a washer 60 (FIGS. 11, 12) is applied for the wheel to engage. Upon turning the threaded rod, the jaws are pulled up together, or released, respectively. The hole 58 is relatively large for enabling limited angular movement of the rod therein. The rod 57 has a thumb wheel 62 for manipulating it. Guide pins 61 may be mounted in the outer jaw for guiding the inner jaw. The swing clamp is applied to the canvas as represented in FIGS. 11 and 12 where the outer and inner jaws 50, 52 are applied to the stretcher strip 32. Further reference to this mounting will be made hereinbelow.

Mounted in the forward end portion of the outer jaw 50 are two sets of guide pins, namely an inner set 63 and an outer set 64, each set including two pins spaced apart vertically, and the two sets being spaced apart longitudinally or horizontally from front to rear. The pins 63 of the inner set are slidable along their own lengths, i.e., from left to right in FIG. 11. This figure shows them in retracted or in active position, extending through the outer surface of the clamp jaw. The pins 64 of the outer set are fixed in position, extending through the inner surface of the clamp jaw. FIG. 11 shows a stretcher strip 32 of large size, and to accommodate this size of stretcher strip, the pins 63 are moved to the right to their inactive position, and the swing clamp is fitted to the stretcher strip in such a manner that the outer pins 64 engage the stretcher strip.

FIG. 12 shows the swing clamp mounted on a small stretcher strip, and in this case the guide pins 63 are moved to their inner, active position, and they engage the small stretcher strip.

In either case, i.e., in mounting on the large stretcher strip of FIG. 11 or the small stretcher strip of FIG. 12, the inner clamp jaw 52 is applied to the corresponding inner surface of the stretcher strip and the thumb wheel is tightened, drawing the clamp jaws against the stretcher strip. Because the rod 57 is displaced to the exterior of the stretcher strip, upon tightening the thumb wheel, there is a tendency for the clamp jaws to swing about the corresponding corners of the stretcher strips at points 65*a*, 65*b*. The dimensions of the inner clamp 52 and the location and large size of the hole 58 are such that the threaded rod 57 assumes an angle relative to the rear surface 65*c* of the stretcher strip. Because of this angular relationship, the wheel engages the washer 60 at point 65*d*, and thereby holds the outer clamp jaw 50 flat against the outer surface of the stretcher strip and thus the swing clamp as a whole straight in fore-and-aft direction. The angular positioning of the surfaces 54*a*, 56*a* aid in this positioning of the outer jaw; additionally, the pins 63, or 64, engaging the front surface of the stretcher strip also aid in holding the swing clamp in the desired position.

Figure 1:
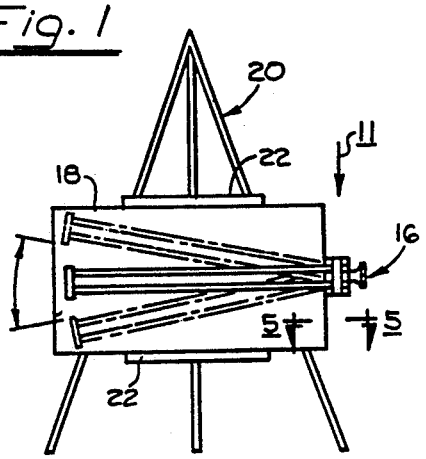
FIG. 1 is front view of a canvas mounted on an easel, with the apparatus of the present invention mounted in place, on the canvas.
Figure 2:
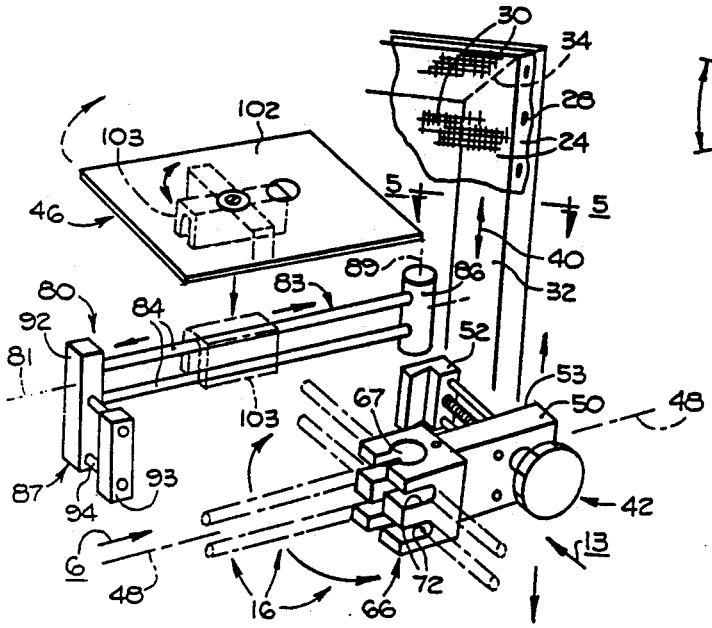
FIG. 2 is a perspective, exploded of the apparatus of the invention, in association with a fragment of a canvas.

Mounted on the forward end of the outer clamping jaw 50 is a coupler 66, which may be of plastic material. This coupler is in the form of a block having a vertical hole 67 therethrough, with a vertical slot 69 leading from the hole forwardly, and a pair of cross slots 72. This coupler is shown in FIGS. 1 and 2 in normal position to be referred to again hereinbelow.

Figure 13:
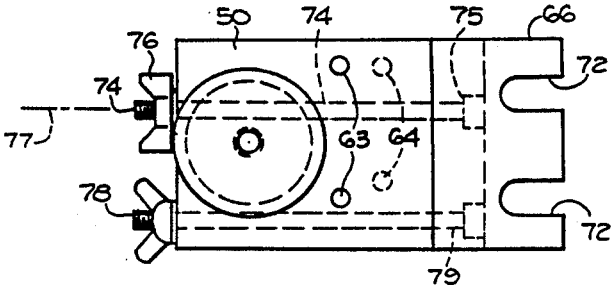
FIG. 13 is a view of the swing clamp taken at the arrow 13 of FIG. 2.

The coupler 66 is fitted to the forward end of the outer clamp jaw 50 and mounted thereon by means of a rod 74 (FIGS. 5, 6 and 13) extending through the jaw and into the coupler where a nut 75 is threaded thereon, positioned in a recess in the coupler. On the outer and rear end of the rod is a thumb nut 76. Upon tightening the thumb nut, the coupler is drawn up tight against the jaw, and upon relieving of the thumb nut, the coupler can be rotated to different positions angularly about the axis 7 of the rod which is parallel with the longitudinal axis 48. the rod 74.

Also mounted in the jaw 50 is another rod 78, adjacent the side of the jaw, retractably extending into the coupler at 79 to releasably secure the coupler in its normal position.

The hand bridge 80 (FIG. 2) is elongated and has a central longitudinal axis 81. It includes bridging means 83 made up of a pair of vertically spaced elements 84, which may for example be aluminum tubes, or equivalent. It also includes inner and outer end members 86, 87 respectively, in which the tubes 84 are secured.

The inner end member 86 is cylindrical in shape and has a central vertical axis 89, this end member serving as a means for mounting the hand bridge as referred to below.

The outer end member 87 includes an element 92 mounted directly on the tubes 84, and another element 93 secured to the element 92 by means of spacer rods 94.

Figure 9:
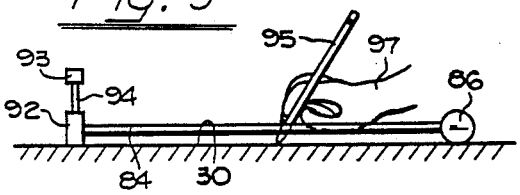
FIG. 9 is a view of the hand bridge used independently as a separate tool.

The inner end member 86 and the element 92 are both of greater transverse dimension than the tubes 84 for spacing the tubes above the art surface as illustrated in FIG. 9. This spacing may be for example on the order of ⅝". In this case the bridge is positioned and spaced from the art surface a short distance, for using a pencil 95. It will be noted that the hand as noted at 97 rests on the hand bridge.

Figure 10:
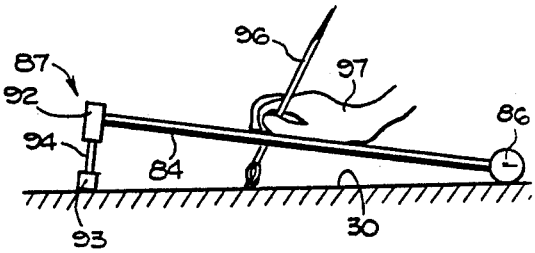
FIG. 10 is a view of the hand bridge of FIG. 9 but in a different position.

The outer end element 87, by means of the spacing of the elements 92, 93 thereof, serves to space the tubes 84 a greater distance from the art surface. This positioning of the hand bridge is utilized in using a brush 96, as shown in FIG. 10, where the brush 96 is held by the hand as at 97, the hand resting on the tubes which are spaced at a greater distance, in keeping with the usual desired manipulation of a brush, as contrasted to a pencil. The vertical dimension (FIG. 10) of the outer element 87 may be as desired, but a convenient spacing may be varying distances of from ⅝" to 3.5".

The hand bridge is mounted on the swing clamp by placing the inner end element 86 in the hole 67 in the coupler, in which it is rotatable, enabling swinging of the hand bridge about the axis 89 (FIG. 2). When it is so swung, the rods 84 enter into the cross slots 72. This swinging movement is represented in FIG. 2.

When the hand bridge is so mounted in the coupler, the elements and components are so arranged so that when the coupler is in its home position, the hand bridge is in a horizontal position as shown in full lines in FIG. 1.

FIG. 1 represents the use of the hand bridge with a vertical canvas, and when mounted in the apparatus. The user rests his hand on the hand bridge, in applying the colors to the canvas, and the hand bridge can be swung vertically as shown in dot-dash lines. This swinging movement is enabled by the rotation of the coupler 66 described above.

Reference is next made to the pallet 46 which includes a board or board element 102 of suitable material, such as mahogany, or any material that is of course not adversely affected by the paints and related mediums. It is of suitable size for holding in the hand, and mounted on the undersurface is a handle 103, which is of inverted U-shape (FIG. 8) with a top portion 103*a* and legs 103*b*, the legs being parallel and together provided with a larger opening 105 extending therethrough. The handle is secured to the board by a screw 106 threaded into the body portion 103*a*, a suitable washer 107 being also used. The handle 103 is swingable about the axis 109 extending through the screw, perpendicular to the board, the purpose of this feature being referred to again below. The board is provided with a brush hole 110 adjacent to the mounting screw 106.

The handle 103 is utilized in holding the pallet manually, the user placing his hand in holding position as indicated at 112, the board thus being held independently of and separate from the other components of the apparatus. In holding the pallet by the handle, contrast is made with the manner in which the pallet was held heretofore, i.e., by means of the user extending his thumb through the hole provided in the pallet. The thumb of course engaged the upper surface of the pallet in holding it, and came in contact with the paints and other mediums thereon which caused discomfort and often serious bad effects in the skin of the user. In the present case the user in holding the pallet has his hand entirely on the underside and does not come in contact with the top surface, or the paint thereon.

Figure 8:
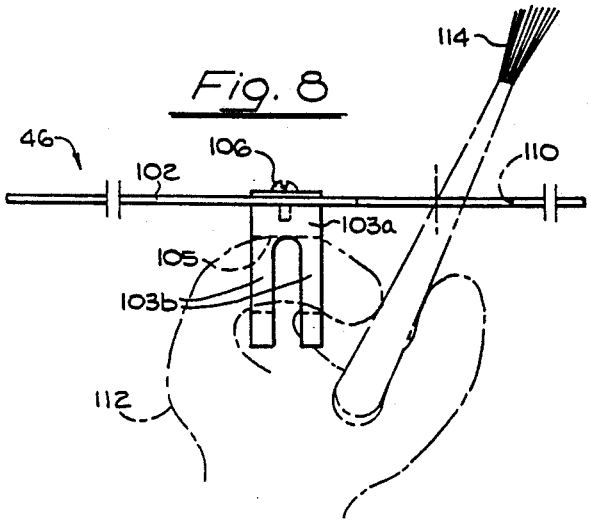
FIG. 8 is a view taken from the left of FIG. 7.
Figure 7:
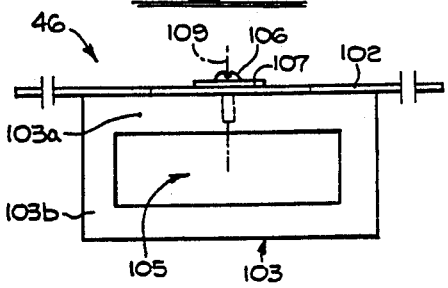
FIG. 7 is a detailed view of the holder on the pallet.

In the use of the pallet in the manner just referred to, in which the hand is entirely below the pallet board, the user can nevertheless easily hold paint brushes that are not being used at the moment. Attention is directed to FIG. 8 where a paint brush 114 is positioned in the brush hole 110, and the handle is gripped by the hand. In using the pallet, the brush is inserted through the hole and grasped by the hand, and so held until later when it is to be used. Thus the user can hold the brush without touching the top surface of the pallet and is thus held by its clean handle. It is pointed out that the opening 105 is relatively large to accommodate several fingers of the user, so that he can hold the pallet firmly.

The spacing of the legs 103*d* of the handle is such that the legs fit over the tubes 84 with a friction fit (FIG. 2). The handle 103, and thus the pallet as a whole, is slidable along the tubes 84 of the hand bridge for correspondingly sliding the pallet for positioning the pallet adjacent one side of the canvas or the other.

By reason of the rotatability of the pallet board 102 on the handle 103, the desired edge or side of the pallet can be placed closely adjacent the canvas, and then the hand bridge can be swung toward the canvas an extent depending on the position of the pallet on the hand bridge.

Thus the arrangement of the hand bridge and pallet can assume four different usages, a) the hand bridge used alone as in FIGS. 9 and 10, b) the hand bridge used when mounted on the swing clamp, without the pallet, c) the pallet mounted on the hand bridge when the hand bridge is mounted on the swing clamp, and d) the pallet used alone.

Thus the arrangement of the several components of the apparatus enable great variety in moving and using the parts; the hand bridge is movable toward and from the canvas, about the vertical axis 89 (FIG. 2); the coupler 66 (FIG. 2) is swingable about the horizontal axis 77 (FIG. 13), and thereby the hand bridge 80 is swingable to upper and lower positions (FIG. 1); the pallet (FIG. 3) is swingable on the hand bridge, about the axis 109.

I claim:

1. An artist's hand bridge for use with an art surface in a supporting structure, the hand bridge being oriented according to a longitudinal axis therethrough, comprising, bridging means having an inner end and an outer end, and inner and outer end mounting elements respectively on the inner and outer ends of the bridging means and being greater in transverse dimension than the bridging means, whereby the hand bridge can be placed over a horizontal art surface with the mounting elements engaging the supporting structure, and the mounting elements spacing the bridging means from the art surface to enable the user to place his hand on the hand bridge and it is thereby held off the art surface.

2. An artist's hand bridge according to claim 1 wherein, the outer mounting element is dimensioned and positioned so as to extend transversely from the bridging means a relatively small amount in one direction and a relatively great amount in the other direction.

3. An artist's hand bridge according to claim 1 wherein, the inner mounting element is shaped and constructed to constitute a pivoting mounting means for swinging movement of the hand bridge about an end axis in the inner mounting element extending transverse to the longitudinal axis.

4. An artist's hand bridge according to claim 3 wherein, the bridging means is constituted by a pair of spaced rods parallel with the longitudinal axis, to provide substantial dimension in the direction of the spacing for support of a pallet.

5. An artist's hand bridge according to claim 3 for use with a canvas having stretcher strips, and having a front surface, in combination with, a swing clamp capable of being ridgidly clamped on one of the stretcher strips, and the swing clamp including a coupler operable for mounting said inner mounting element therein for swinging movement of the hand bridge about said end axis.

6. A combination according to claim 5 wherein, the swing clamp is so constructed that when it is clamped on the stretcher strip, said coupler is in front of the canvas, spaced therefrom, and the inner mounting element is cylindrical in shape, and the coupler has a socket, correspondingly cylindrical, receiving the inner mounting element.

7. A combination according to claim 6 wherein, the bridging means includes a pair of spaced tubes parallel with the longitudinal axis, and the coupler has cross slots perpendicular to the end axis and receiving said rods in response to swinging movement of the hand bridge about said end axis.

8. A combination according to claim 7 wherein, the swing clamp has a length dimension determining a length axis therethrough perpendicular to the canvas, and perpendicular to said end axis, and said coupler is rotatable about said length axis.

9. A combination according to claim 8 wherein, the clamp means is so constructed that said cross slots extend generally parallel with the canvas whereby the slot surfaces support the hand bridge when the latter is positioned adjacent to the canvas.

10. A combination according to claim 5 and further including, means for locking the hand bridge in a home position of its swinging movement about the end axis.

11. A combination according to claim 5 for use with either of canvas structures having stretcher strips of different cross sectional dimensions, the stretcher strips having outer surfaces in the perimeter of the canvas and inner surfaces opposite the outer surfaces, and having rear surfaces and front surfaces spaced apart in thickness direction, wherein, the swing clamp has outer and inner clamping jaws respectively engaging the outer and inner surfaces of the corresponding stretcher strip, and the swing clamp also has first and second sets of bracing pins on the outer clamping element, spaced apart in said thickness direction, the first set of the pins being located for engaging the front surface of a thinner stretcher strip and being selectively movable into and out of active position at that location, and the second set of the pins being located for engaging the front surface of a thicker stretcher strip.

12. A combination according to claim 5 wherein, the clamping jaws have surfaces engageable with the outer and inner surfaces of the stretcher strip throughout the thickness of the latter perpendicular to the front face of the canvas, the swing clamp, has a tightening screw displaced rearwardly of the stretcher strips and connected with the clamping jaws for enabling relative movement of the latter on the screw, and the inner clamping jaw having conformation engaging the stretcher strip in such manner as to enable flat contact engagement of the outer clamping jaw with the outer surface of the stretcher strip.

13. A combination according to claim 5 in combination with, an artist's pallet including a board and a handle on an under side thereof, the handle being operable for detachably mounting the board on the hand bridge for sliding movement on the hand bridge longitudinally of the hand bridge.

14. A combination according to claim 13 wherein, the board is mounted on the handle for rotational movement thereon about an axis through and perpendicular to the board and through the handle.

15. A combination according to claim 14 wherein, the hand bridge has substantial dimension in direction parallel with the art surface, and the handle includes a pair of spaced apart plate-like elements for receiving the hand bridge therebetween for frictionally gripping it and thereby detachably holding the pallet thereon.

16. A combination according to claim 12 wherein, the swing clamp includes a thumb wheel on the tightening screw, the elements of the structure are such as to be operable to positioning the tightening screw at an acute angle to the rear surface of the stretcher strip, and the thumb wheel in response to its tightening up thereon, engages the outer jaw at a position within the front-to-rear confines of the stretcher strip and thereby holds the outer jaw flat against the stretcher strip.

17. An artist's pallet for use with an elongated hand bridge, comprising, a board having an under surface, a handle secured on the under surface operable for enabling rotation of the board on the handle about an axis perpendicular to the board and extending through the handle, and the handle including means for frictionally and releasably mounting the handle on the hand bridge for enabling the handle and thus the board to be adjustably moved along the hand bridge, and for enabling release of the pallet from the hand bridge for carrying by the artist.

18. An artist's pallet according to claim 17 wherein, the board has a brush hole therethrough closely adjacent the handle.

19. An artist's pallet according to claim 2 wherein, the handle includes a pair of parallel, spaced vertical plate-like legs defining a longitudinal space therebetween adapted for frictionally and releasably receiving the hand bridge therebetween for so mounting the handle on the hand bridge, whereby the hand bridge correspondingly supports the pallet, said legs together also forming a transverse hole there-through perpendicular to the plate-like extension of the legs, for receiving the hand of the user for holding the pallet, and said legs so defining said longitudinal space as unimpeded and open in both of mutually perpendicular directions as to enable free reception of the hand bridge, and full and free reception of the user's hand.

* * * * *